US005598168A

United States Patent [19]

Evans et al.

[11] Patent Number: 5,598,168

[45] Date of Patent: Jan. 28, 1997

[54] HIGH EFFICIENCY MICROSTRIP ANTENNAS

[75] Inventors: James G. Evans, Colts Neck; Martin V. Schneider; Robert W. Wilson, both of Holmdel, all of N.J.

[73] Assignee: Lucent Technologies Inc., Murray Hill, N.J.

[21] Appl. No.: 351,904

[22] Filed: Dec. 8, 1994

[51] Int. Cl.[6] ..... H01Q 11/38

[52] U.S. Cl. ..... 343/700 MS

[58] Field of Search ..... 343/700 MS; H01Q 1/38

[56] References Cited

U.S. PATENT DOCUMENTS

| | | | |
|---|---|---|---|
| 4,131,893 | 12/1978 | Munson et al. | 343/700 MS |
| 4,218,682 | 8/1980 | Yu | 343/700 MS |
| 4,329,689 | 5/1982 | Yee | 343/700 MS |
| 4,701,763 | 10/1987 | Yamamoto et al. | 343/700 MS |
| 4,728,962 | 3/1988 | Kitsuda et al. | 343/700 MS X |
| 4,835,538 | 5/1989 | McKenna et al. | 343/700 MS |
| 4,835,540 | 5/1989 | Haruyama et al. | 343/700 MS |
| 4,847,625 | 6/1989 | Dietrich et al. | 343/700 MS |
| 4,903,033 | 2/1990 | Tsao et al. | 343/700 MS |
| 5,124,713 | 6/1992 | Mayes et al. | 343/700 MS |
| 5,124,733 | 6/1992 | Haneishi | 343/700 MS X |

FOREIGN PATENT DOCUMENTS

| | | | |
|---|---|---|---|
| 2147744 | 5/1985 | United Kingdom | 343/700 MS |

OTHER PUBLICATIONS

Katechi et al, "A Bandwidth Enhancement Method for Microstrip Antennas," 1985, pp. 404–406.

Bahl et al, *Microstrip Antennas*, 1980, p. Appendix C.

*Primary Examiner*—Donald T. Hajec

*Assistant Examiner*—Steven Wigmore

[57] ABSTRACT

The effectiveness of a microstrip conductor antenna, such as a patch antenna, is improved at any particular frequency by making the thickness of the conductor sufficiently small to reduce shielding and losses caused by the skin effect and make currents at the upper and lower surfaces couple with each other and make the conductor partially transparent to radiation. In one embodiment the thickness is between 0.5δ and 4δ. Preferably the thickness is between 1δ and 2δ where δ is equal to the distance at which current is reduced by 1/e., for example 1.5 to 3 micrometers at 2.5 gigahertz in copper. According to an embodiment, alternate layers of dielectrics and radiation transparent patches on a substrate enhance antenna operation.

11 Claims, 3 Drawing Sheets

HIGH EFFICIENCY MICROSTRIP ANTENNAS

This application is related to our co-pending applications entitled "IMPROVEMENTS IN SMALL ANTENNAS SUCH AS MICROSTRIP PATCH ANTENNAS", Ser. No. 08/351,912, filed concurrently herewith, "ANTENNAS WITH MEANS FOR BLOCKING CURRENTS IN GROUND PLANES", Ser. No. 08/351,905, filed concurrently herewith, "IMPROVEMENTS IN MICROSTRIP PATCH FILTERS" Ser. No. 08/406,289, filed Mar. 17, 1995, and MICROSTRIP PATCH ANTENNAS WITH RADIATION CONTROL, Ser. No. 08/406,290, filed Mar. 17, 1995, all assigned to the same assignee as this application.

FIELD OF THE INVENTION

This invention relates to microstrip antennas, and particularly to high efficiency microstrip antennas.

BACKGROUND OF THE INVENTION

Microstrip antennas and their histories are described in the "Proceedings of the IEEE", Volume 80, No. 1, January 1992. The basic configuration of the microstrip antenna is a metallic conductor, such as a patch printed on a thin, grounded, dielectric substrate. This element can be fed either with a coaxial line through the bottom of the substrate or by a co-planar microstrip line. A microstrip antenna radiates a relatively broad beam broadside to the plane of the substrate.

Because of the skin effect, currents in a microstrip antenna flow mainly in the outer and inner surfaces of the conductor, for example the patch. The inner surface of the patch adjacent the dielectric substrate, faces the ground plane. Accordingly, the current on the inner surface is substantially higher than the current on the outer surface. However, it is mainly the outer surface which radiates or receives radiation. Currents on the inner surface are incapable of producing radiation because the conductive portion of the patch between the outer and inner surface blocks radiation which the current at the inner surface may generate. This limits the efficiency of the radiation.

An object of the invention is to improve microstrip antennas.

SUMMARY OF THE INVENTION

According to an aspect of the invention, a microstrip antenna includes a ground plane, a dielectric substrate over the ground plane, and having, deposited on the dielectric, a microstrip conductor, such as a microstrip patch. The microstrip patch has a thickness sufficiently small to make the conductor substantially transparent to radiation at the frequency at which the antenna is to operate. In one embodiment, the conductor has a thickness from $0.5\delta$ to $4\delta$ where $\delta$ is the skin depth at the antenna operating frequency, and preferably $\delta$ to $2\delta$.

According to an aspect of the invention, the conductor is in the form of a patch.

These and other aspects of the invention are pointed out in the claims. Other objects and advantages of the invention will become evident from the following detailed description when read in light of the accompanying drawings.

DETAILED DESCRIPTION OF PREFERRED EMBODIMENTS

Figure 1:
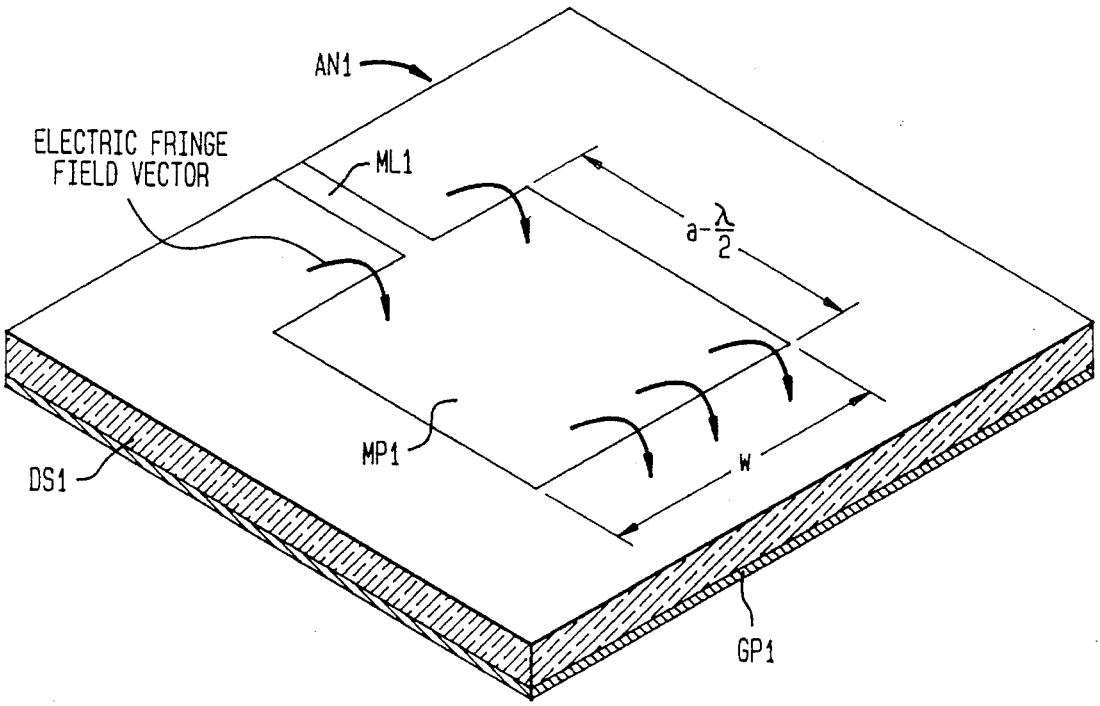
FIG. 1 is a perspective view of a microstrip antenna embodying features of the invention.
Figure 2:
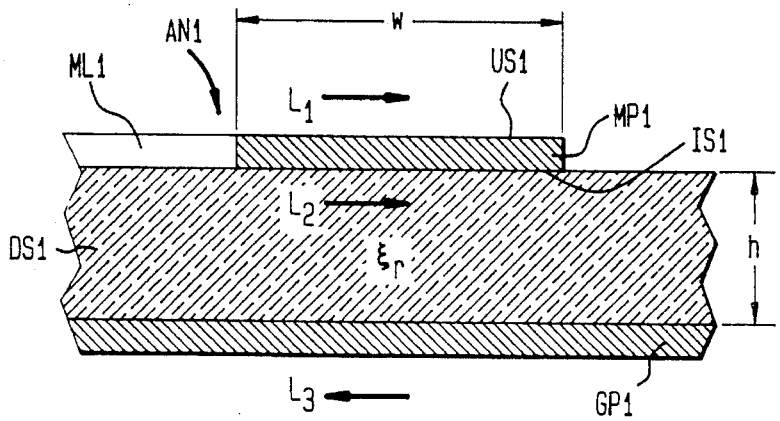
FIG. 2 is a cross-sectional view of the microstrip antenna in FIG. 1.

FIGS. 1 and 2 illustrate perspective and cross-sectional views of a microstrip antenna AN1 embodying features of the invention, with thicknesses exaggerated for clarity. In FIG. 1, the microstrip antenna AN1 includes a microstrip line ML1 which feeds a microstrip patch MP1 deposited on a dielectric substrate DS1, and a ground plane GP1 under the dielectric substrate.

According to an embodiment of the invention, the thickness of the microstrip patch MP1, namely its distance from its upper surface US1 to the inside surface IS1 adjacent the substrate DS1 is sufficiently small so that the patch becomes substantially transparent to radiation over the range of frequencies at which the antenna AN1 operates. This allows the larger current $i_2$ at the inner surface IN1 of the patch MP1 facing the dielectric substrate DS1, and hence facing the ground plane GP1, to couple with, and add its effect on radiation, to the smaller current $i_1$ at the upper surface US1. A current $i_3$ flows in the ground plane and is substantially equal to $i_1 + i_2$. Hence, the invention overcomes the undesirable effect of conductive material between the upper and the inside surfaces of prior microstrip antennas shielding the radiation produced or sensed by the currents in the inner surface.

The antenna AN1 in FIG. 1 is linearly polarized. The length of the patch in FIG. 1 is, for example $\lambda/2$, where $\lambda$ is the wavelength of the center frequency of the operating range of the antenna AN1.

According to an embodiment of the invention, the thickness of the microstrip patch MP1, namely the distance between its upper surface US1 and the inside surface IS1 adjacent the dielectric substrate DS1 is equal to $0.5\ \delta$ to $4\delta$ and preferably $\delta$ to $2\delta$, where $\delta$ is the skin depth. The skin depth depends upon the frequencies at which the antenna AN1 is to operate. The operating frequency is, for practical purposes, the center frequency of the range of frequencies at which the antenna is to be used. Skin depth is defined in the book "Reference Data For Engineers: Radio, Electronics, Computer, and Communications", seventh edition published by Howard W. Samms and Company, A Division of MacMillan, Inc. 4300 West 62nd Street, Indianapolis, Ind, 46268. The skin depth $\delta$ is that distance below the surface of a conductor where the current density has diminished to 1/e of its value at the surface. At 2.5 gigahertz (GHz), the skin depth in copper is about 1.5 micrometers (μm). Thus in one embodiment the thickness is 0.75 μm to 6 μm and in another 1.5 μm to 3 μm in copper.

In operation, a transmitter and receiver are connected across the stripline MS1 and the ground plane GP1. In the transmit mode, the transmitter applies voltage across the microwave stripline ML1 and the ground plane GP1 at a microwave frequency such as two GHz. The currents appearing at the upper and inner surfaces US1 and IS1 of the microwave patch MP1 couple to each other and add to produce radiation transverse to the plane. The microstrip antenna MA1 then radiates a relatively broad beam broadside to the plane of the substrate. In the transmit mode, the invention increases the radiation output because the transparency of the microstrip patch MP1 according to the invention permits the surface currents $i_1$ and $i_2$ to couple and effectively allows radiation from the inner surface IS1 through the transparent patch.

In the receive mode, the microstrip antenna MA1 and the path of propagation of radiation at frequencies such as two GHz. The latter generate currents in both the upper and lower surfaces US1 and IS1 of the microstrip patch MP1. More specifically, the currents in the upper and lower surfaces couple to each other and operate in additive fashion. The microstrip line ML1 and the ground plane GP1 pass the currents to the receiver in the receive mode. The currents passed to the receiver are therefore substantially higher than would be available from microstrip patches thicker than those of the present invention, because the patches would not be transparent to radiation. The lack of transparency would effectively prevent significant current in the inner surface IS1, and allow the receiver to sense currents only in the upper surface US1.

Figure 3:
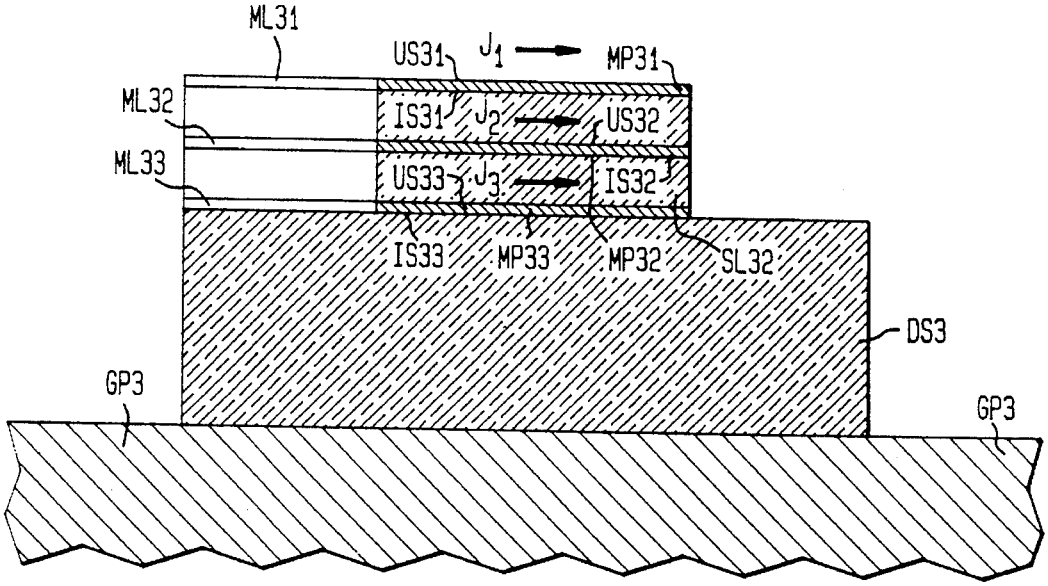
FIG. 3 is a cross-sectional view of another antenna embodying features of the invention.
Figure 4:
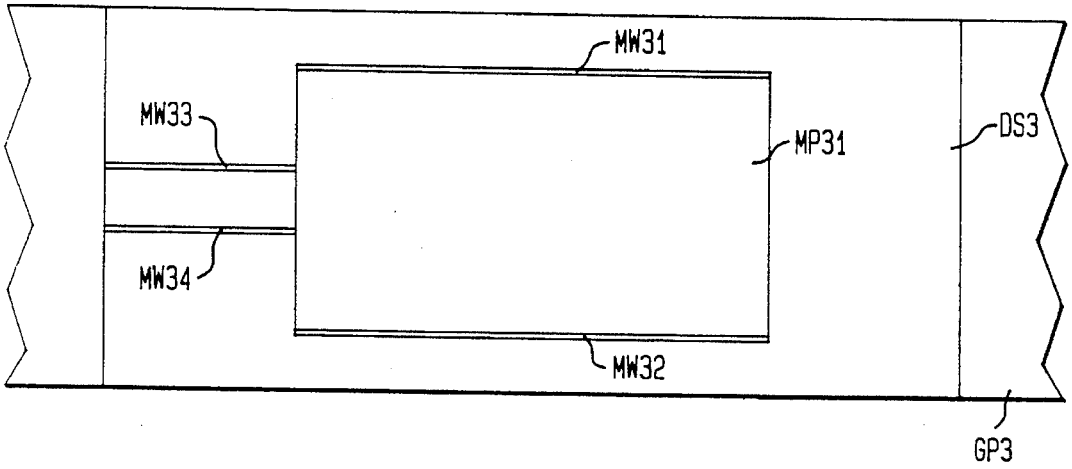
FIG. 4 is a plan view of the microstrip antenna in FIG. 3.
Figure 5:
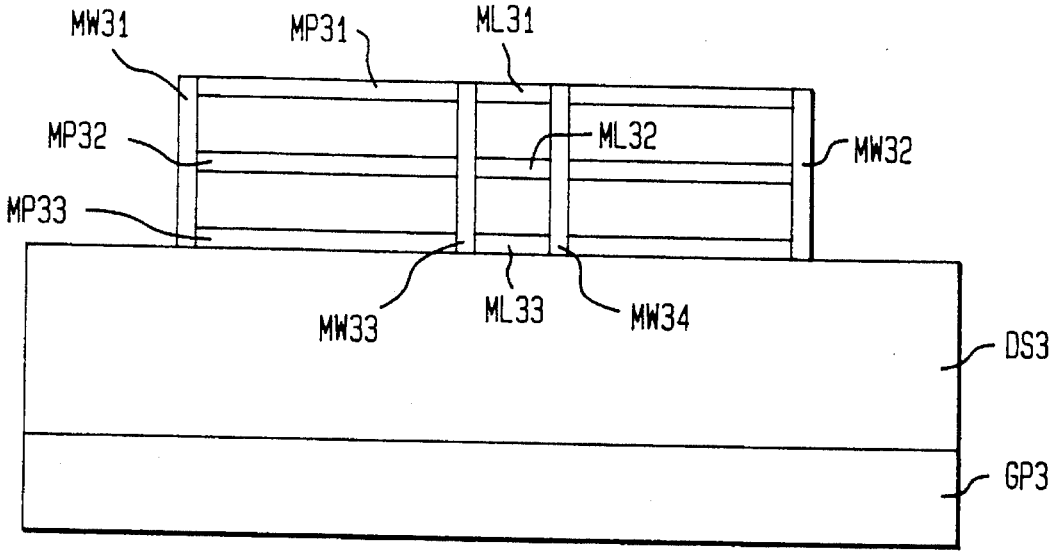
FIG. 5 is a end elevational view of the microstrip antenna in FIG. 3.

FIG. 3 illustrates another embodiment of the invention which takes advantage of the transparent characteristics of the patch MP1 in FIG. 1. Here, dielectric spacer layers SL31 and SL32 space three microstrip patches MP31, MP32, and MP33 deposited on a dielectric substrate DS31 over a ground plane GP3. FIG. 4 is a plan view, and FIG. 5 a side elevation, of the microstrip antenna in FIGS. 3. In FIGS. 3, 4 and 5 the thicknesses are also exaggerated for clarity. Metal walls MW31 and MW32 are deposited on each side of the dielectric spacer layers SL31 and SL32 and the three microstrip patches MP31, MP32, and MP33 to connect the three microstrip patches so they are at the same potential. Suitable microstrip lines ML31, ML32, and ML33 connect the microstrip patches MP31, MP32, and MP33 to the edge of the dielectric substrate DS3 for connection to the output of a transmitter and the input of a receiver. The dielectric spacer layers SL31 and SL32 also space the lines ML31, ML32, and ML33. The sides of the lines ML31, ML32, and ML33, as well as the spacer layers SL31 and SL32 are covered by metal walls MW33 and MW34. The walls are not intended to have load bearing capability but only to provide conductive connections between the metal layers and lines to maintain them at the same potential. According to another embodiment, one or more of the metal walls are omitted.

In the transmit mode, currents appearing in the upper and inner surfaces US31 and IS31, of each of the patches add with each other to produce enhanced radiation. Here the radiation arising from currents in the upper and inner surfaces US33 and IS33 of the microstrip patch MP33 add to the radiation produced by currents in the upper and inner surfaces US32 and IS32 the patch MP32, and currents in the upper and inner surfaces US31 and IS31 of the patch MP31 because of the transparent nature of each of these patches, each of which has a thickness equal to 0.5δ to 4δ and preferably δ to 2δ. At 2.5 GHz the skin depth δ is about 1.5 μm.

The currents in the three microstrip patches MP31, MP32, and MP33 tend to hug the edges. The purpose of the metal walls MW31, MW32, MW33, and MW34 is to place the edges of the three microstrip patches MP31, MP32, and MP33 and lines ML31, ML32, and ML33 at the same potential.

According to another embodiment of the invention, the dielectric spacer layers SL31 and SL32 extend beyond the edges of the microstrip patches MP31, MP32, and MP33, and preferably to the edges of the dielectric substrate DS31.

Figure 6:
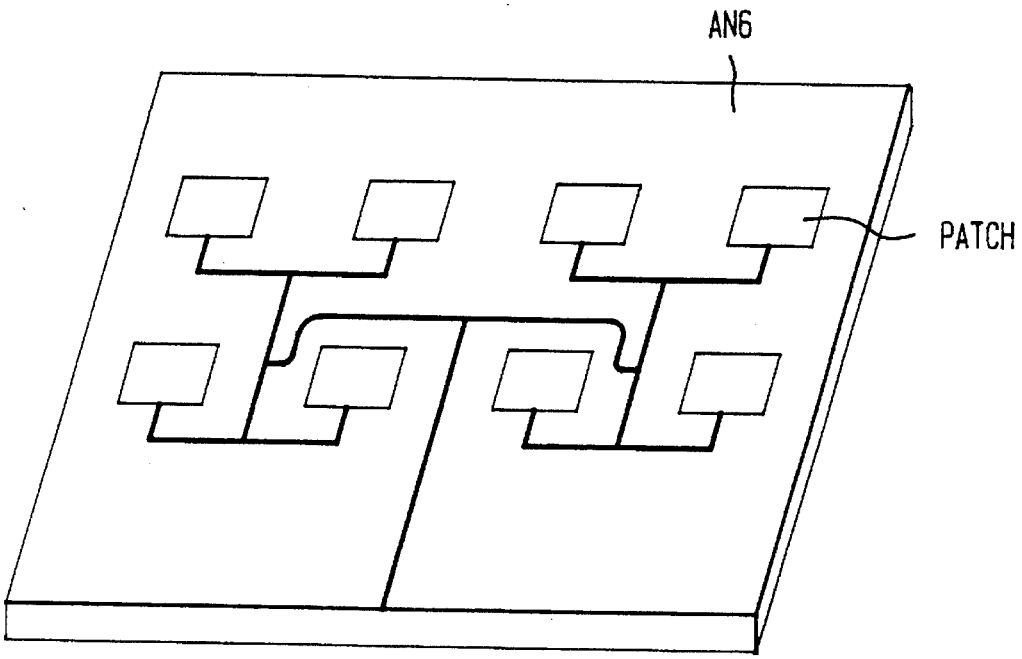
FIG. 6 is a perspective view of another antenna embodying features of the invention.

According to other embodiments of the invention, variations in patch shape along the width and length, feeding techniques and substrate configurations, and array geometries are employed. Such variations correspond to known variations, but incorporate the patch thickness disclosed. An example appears in FIG. 6 showing an antenna AN6 with an eight patch array.

The transparency of the conductors allows an increase in the efficiency and bandwidth of the operation of the antenna.

While embodiments of the invention have been described in detail it will be evident to those skilled in the art that the invention may be embodied otherwise without departing from its spirit and scope.

What is claimed is:

1. A microstrip antenna for operation at a predetermined frequency, comprising:

a ground plane;

a dielectric substrate on said ground plane; and a microstrip conductor arrangement having a microstrip conductor deposited on said substrate;

said microstrip conductor having a thickness sufficiently small to be substantially transparent to radiation is defined as permitting RF currents on an inner surface of said microstrip conductor to produce radiation, said inner surface being adjacent and facing said ground plane.

2. A device as in claim 1, wherein the microstrip conductor exhibits a skin effect and the thickness of the microstrip conductor is between 0.5δ and 4δ, wherein δ is the thickness of the skin effect.

3. A device as claim 2, wherein the thickness of the microstrip conductor is between δ and 2δ.

4. A device as in claim 2, wherein said thickness is 1.5 to 3 μm for a frequency of 2.5 gigahertz in copper.

5. A device as in claim 1, wherein the conductor is a microstrip patch.

6. A device as in claim 5, wherein said conductor arrangement includes a dielectric spacer mounted on said microstrip patch and a second microstrip patch mounted on said dielectric spacer, the second microstrip patch having a thickness sufficiently small to be substantially transparent to radiation at the predetermined frequency.

7. A device as in claim 5, wherein said microstrip conductor arrangement includes a plurality of additional microstrip patches and a plurality of dielectric spacers between said additional microstrip patches mounted on said first microstrip patch; said microstrip patches each having a thickness sufficiently small to be substantially transparent to radiation at the predetermined frequency.

8. A device as in claim 6, wherein said microstrip patches have edges and said dielectric spacer extends to the edges of the microstrip patches.

9. A device as in claim 7, wherein said microstrip patches have edges and said dielectric spacers extend beyond the edges of the microstrip patches.

10. A device as in claim 7, wherein said microstrip patches have edges and a conductor connects an edge of each of the microstrip patches.

11. A device as in claim 7, wherein said microstrip patches have edges and a conductor connects two edges of each of the microstrip patches.

* * * * *